US005085187A

United States Patent [19]

Black

[11] Patent Number: 5,085,187

[45] Date of Patent: Feb. 4, 1992

[54] INTEGRAL ENGINE OIL PUMP AND PRESSURE REGULATOR

[75] Inventor: Gregg T. Black, Livonia, Mich.

[73] Assignee: Chrysler Corporation, Highland Park, Mich.

[21] Appl. No.: 667,146

[22] Filed: Mar. 11, 1991

[51] Int. Cl.[5] ..... F01M 1/02

[52] U.S. Cl. ..... 123/196 R; 123/198 C; 417/283; 418/171

[58] Field of Search ..... 417/283; 418/171, 166; 123/196 R, 198 C

[56] References Cited

U.S. PATENT DOCUMENTS

| | | | |
|---|---|---|---|
| 3,208,392 | 9/1965 | Garrison et al. | 418/171 |
| 3,443,522 | 5/1969 | Schindler | 417/283 |
| 3,822,965 | 7/1974 | Drutchas et al. | 417/283 |
| 4,253,803 | 3/1981 | Wormmeester et al. | 417/283 |
| 4,974,562 | 12/1990 | Ishii et al. | 123/198 C |
| 4,976,595 | 12/1990 | Taniguchi | 418/171 |

FOREIGN PATENT DOCUMENTS

| | | | |
|---|---|---|---|
| 3543488 | 6/1987 | Fed. Rep. of Germany | 418/171 |

*Primary Examiner*—E. Rollins Cross
*Assistant Examiner*—Erick Solis
*Attorney, Agent, or Firm*—Kenneth H. MacLean

[57] ABSTRACT

A combination gear type oil pump and pressure regulator is disclosed, particularly for a lubricating system of an internal combustion engine. Elements of a gear type pump are housed within an internal recess in the engine crankcase. An end cover is positioned between an enlarged portion of the crankshaft and gear elements and is biased thereagainst by a carefully selected spring which is positioned between the cover member and the enlarged crankshaft portion so that when a predetermined high pressure is formed at the pump outlet, the spring allows the end cover to move away from the pump elements to relieve the pressure by spillage in to the engine crankcase.

8 Claims, 2 Drawing Sheets

INTEGRAL ENGINE OIL PUMP AND PRESSURE REGULATOR

BACKGROUND OF THE INVENTION

1. Field of Invention

The present invention concerns a combination gear type oil pump and pressure regulator for an internal combustion engine.

2. Description of the Related Art

The basic gear type oil pump is well known. For a considerable period of time, this type of pump has been used with oil furnaces. Its usefulness in internal combustion engine lubricating systems is also known. Such a pump is compact and can be positioned within a recess of the engine block and directly driven by the crankshaft. An example of such an application is found in U.S. Pat. No. 3,208,392 to Garrison which was issued Sept. 28, 1965.

The basic construction of the subject gear type fuel pump is similar to the above identified Garrison patent. It discloses a gear type oil pump which is driven by a crankshaft and is designed to operate if rotated in either alternate direction. The Garrison device is a basic gear type pump and includes reed valving for the output of the fluid. It does not provide a combination pump and a pressure regulator as does the subject device.

SUMMARY OF THE INVENTION

The subject gear type oil pump includes the usual inner and outer gear elements which rotate in a recess formed in an engine block. The engine crankshaft extends through the inner gear element to rotate it. In turn the inner element causes the outer element to rotate. Both elements slidingly rotate against a flat end cover member. A spring associated with the cover member normally biases the cover member against the element to seal the pumping chambers formed between the elements. The spring is selected to yield to a predetermined pressure at the outlet of the pump to permit the cover member to move slightly away from the elements an "spill" oil into the engine crankcase thus relieving oil pressure. By this means, a separate oil pressure regulator is eliminated.

Further details as well as other advantageous features of the subject combination oil pump and pressure regulator will be clearer after a reading of the detailed description of a preferred embodiment and reference to the drawings of the embodiment as described below.

IN THE DRAWINGS

FIG. 1 is a perspective, exploded view of the subject combination oil pump and pressure regulator; and FIG. 2 is a sectioned elevational side view of the forward portion of an engine with the subject oil pump and pressure regulator in a first mode of operation at or below a prescribed maximum oil pressures; and FIG. 3 is a sectioned end view of the oil pump and pressure regulator taken along section line 3—3 in FIG. 2 and looking in the direction of the arrows; and FIG. 4 is a sectioned elevational side view like FIG. 2 but in an alternate second mode of operation above a prescribed maximum oil pressure.

DETAILED DESCRIPTION OF AN EMBODIMENT

Figure 1:
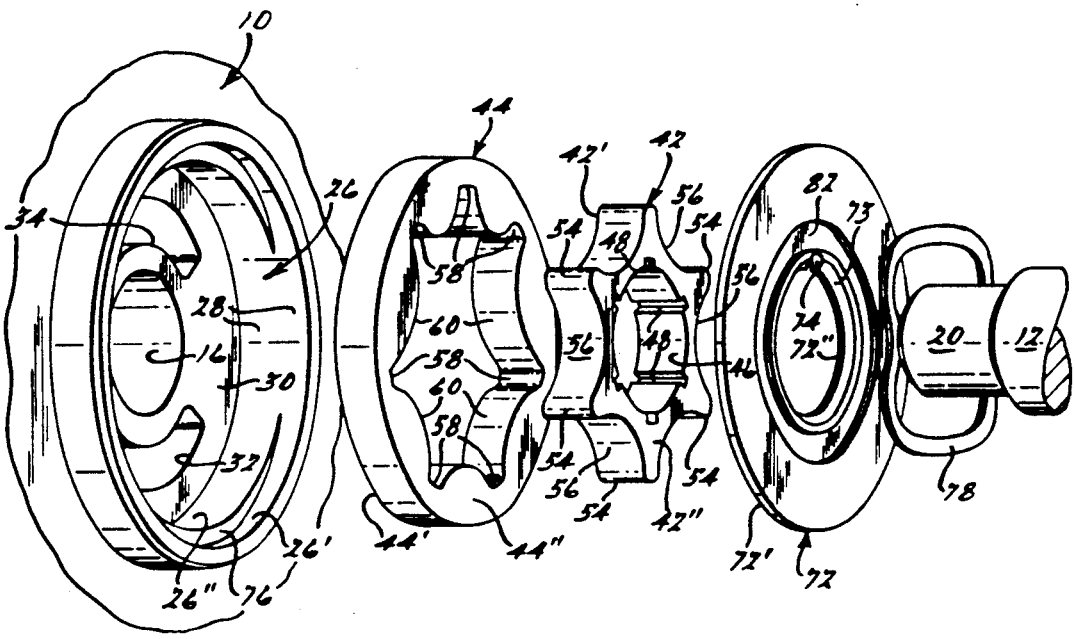
Figure 3:
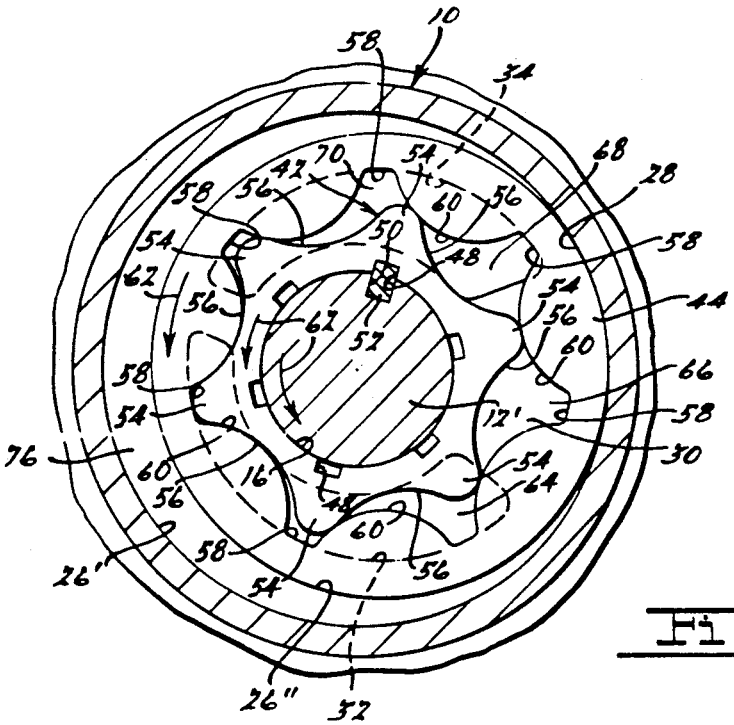
Figure 2:
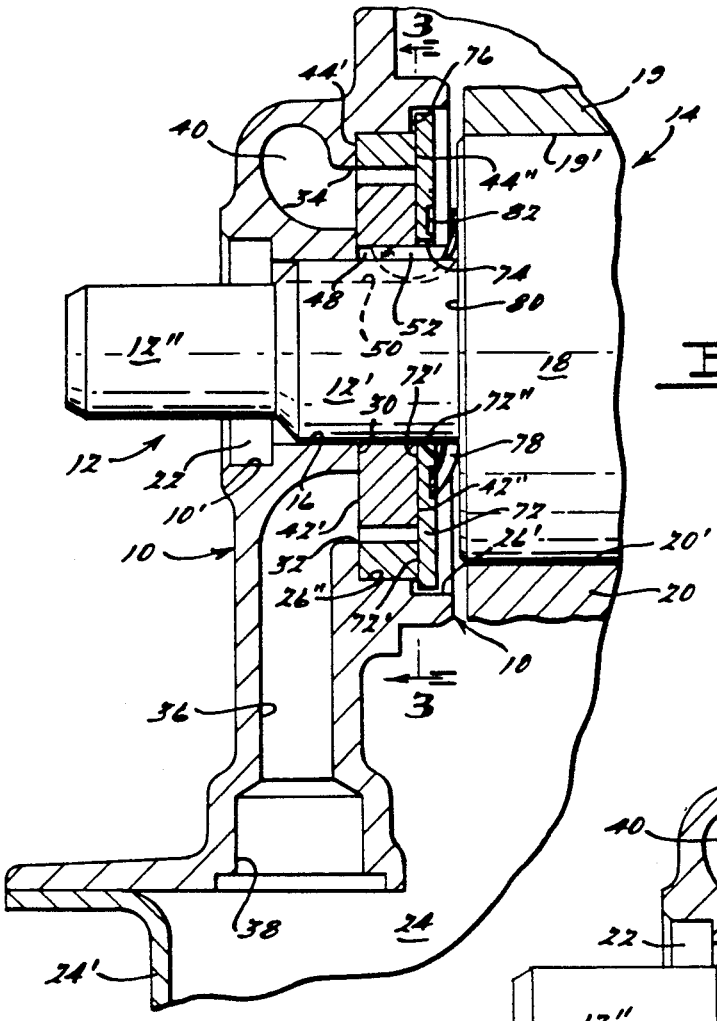

In FIGS. 1-3, a portion of an internal combustion engine is illustrated in association with the subject combination oil pump and pressure regulator. Specifically, in FIG. 2 an end wall of an oil pump housing 10 located at the forward portion of the engine is shown. A step configured end portion 12 of the engine's crankshaft 14 is shown with end portions 12' and 12''. End portion 12' is extended through an opening 16 in the wall of the oil pump housing 10. The end portion 12 extends axially outward from a larger diameter journal portion 18 of the crankshaft 14. The journal portion 18 is secured between a semicylindrical bearing surface 19' of a portion 19 of the engine block and a semicylindrical bearing surface 20' of a bearing cap 20 as is common in the engine art. This structure along with other similar crankshaft bearing support structures (not shown) rigidly supports the crankshaft for rotation in the engine.

The extreme end portion 12'' of the crankshaft 14 projects externally from the housing 10 which permits a pulley or the like to be attached to the engine crankshaft for driving engine accessories through a belt (neither pulley or belt are shown). The housing 10 defines an annular cavity or channel 10' about the portion 12'' to receive an oil seal 22 about end portion 12'' of the crankshaft 14. The seal 22 prevents leakage of oil from the housing 10 or from interior 24 of the engine along the crankshaft end 12. The interior 24 partially serves to define an oil reservoir in an oil pan member 24', part of which is shown.

A step configured recess 26 is defined in the interior side of housing 10 including a large diameter cylindrical portion 26' and a smaller diameter cylindrical portion 26'', as best shown in FIG. 1 which looks upon the interior surface of the housing 10. The axes of the cylindrical portions 26' and 26'' are slightly offset but both portions share a common wall portion 28 for a limited extent of their circumferences. Recess 26 has a flat end surface or bottom wall 30 the plane of which is normal to the axes of crankshaft 14 and cylindrical portions 26', 26''. The bottom wall 30 of recess 26 is pierced by an arcuately shaped inlet opening 32 and an arcuately shaped outlet opening 34. By reference to FIG. 2, it can be seen that inlet opening 32 connects to an intake passage 36 in the housing 10. The inlet passage 36 in turn is adapted to be connected to an oil pickup means (not shown) to transmit oil from the interior or oil reservoir 24 of the engine. The oil pickup means is adapted to engage an enlarged inlet opening 38 formed in the housing 10. Likewise, outlet opening 34 connects with an oil outlet passage 40 in housing 10 the outlet passage is adapted to connect to the engine's lubricating system.

Again referring to FIG. 1, the preferred oil pump is an gear type which includes an inner gear pump element 42 and an outer gear pump element 44, both of the same thickness. Both inner and outer elements have central openings formed therethrough so that the two elements can nest together, with the inner element encircled by the outer element. The peripheral edge configuration of the outer element is cylindrical and sized in relation to the smaller diameter recess portion 26'' so that both elements mount within the recess 26'' and are free to rotate therein.

The inner element 42 has a central aperture 46 through which end portion 12 of the crankshaft 14 extends. The inner element 42 has six axially extending channels or keyways 48 formed in aperture 46. When the inner element is assembled to the portion 12' of crankshaft 14, one of the keyways 48 is aligned with a like formed channel or keyway 50 which is cut into portion 12' of the crankshaft 14. A semicircular flat key 52 is positioned in aligned keyway channels 48, 50 to effectively secure crankshaft 14 and the inner element 42 together for rotation together.

The outer peripheral edge of the inner oil pump element 42 has a contour or configuration including evenly spaced lobes 54 in the circumferential direction. The lobes 54 extend radially outwardly and are connected by inwardly curved connecting surfaces 56. The inner edge configuration of the central opening in the outer oil pump element 44 also has a contoured edge which is complimentary to the outer edge of the inner element. This inner edge is configured with evenly spaced pockets 58 and with curved surfaces 60 extending therebetween. The pockets 58 are complimentary to the lobes 54 and the curved surfaces 56 are complimentary to the curved surfaces 60. The illustrated embodiment of the oil pump illustrates six lobes 54 on the inner element 42 and seven pockets 58 in the outer element 44. Because the outer element has one more pocket than the number of lobes on the inner element, one complete rotation of the six lobed inner element 42 by the crankshaft causes the seven pocketed outer element 44 to rotate about 0.857 (6/7 th) of a complete rotation in the cylindrical recess 26".

The view of the gear pump in FIG. 3 is from the interior of the engine. Therefore, the usually standard clockwise rotation of vehicle engines (viewed head on toward the front exterior) would be indicated by a counterclockwise rotation of the elements 42, 44 as indicated by arrows 62. Note in the lower righthand portion of FIG. 3, a space 64 between the elements 42 and 44 expands in volume as the shaft 12 rotates counterclockwise. This space overlies the inlet opening 32 and oil is drawn into the space therethrough. The expansion of the spaces is evident by noting the next space 66 advancing counterclockwise. Finally, note space 68 and the next space 70 overlying the outlet opening 34. As we progress in the counterclockwise direction, the spaces contract or become progressively smaller. Thus, oil is discharged from the spaces into the outlet 34.

Figure 4:
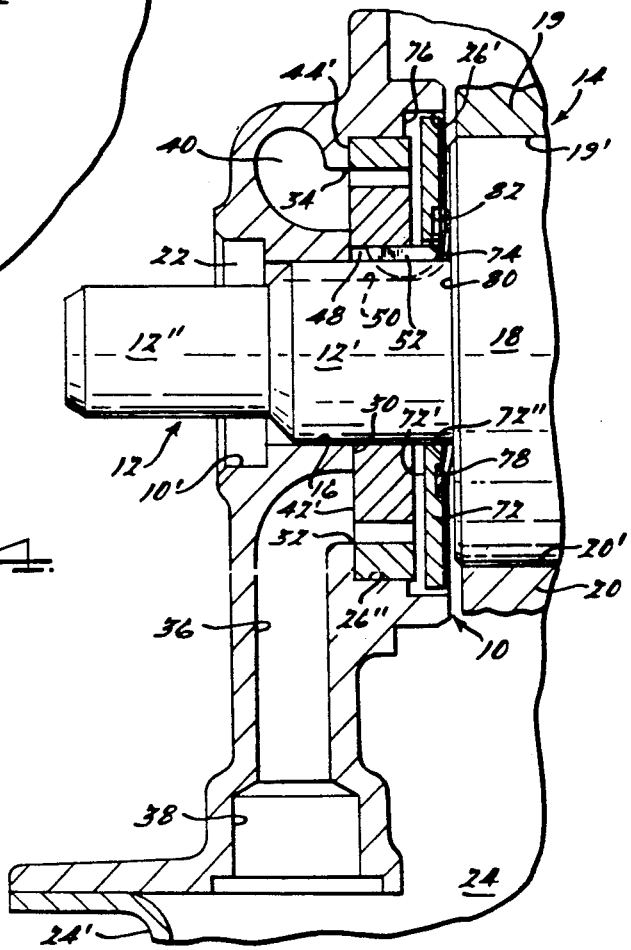

It has been explained that the pumping elements 42, 44 rotate in the cylindrical recess 26". One side surface 42', 44' of each element 42, 44 slides against bottom wall 30 as the elements rotate. The opposite sides surfaces 42" and 44" of elements 42, 44 are covered by the surface 72' of an end cover member 72. The diameter of member 72 is sized relative to the diameter of recess portion 26" so a slight annular gap is formed therebetween as seen in FIGS. 2, 4.

As does the inner gear element 42, the end member 72 has a central aperture 72" to receive the portion 12' of the crankshaft. Aperture 72" is encircled by a beveled surface 73 best seen in FIG. 1. A keyway 74 is formed in the member 72 for key 52 so that the end member if attached to the crankshaft 14 for rotation therewith and with the inner pump element 42. Note in FIG. 2 that the thickness of the elements 42, 44 is slightly greater than the depth of the recess 26". Resultantly, the elements 42, 44 project slightly from an intermediate surface 76 located between the recess portions 26' and 26". Resultantly, the moving outer peripheral edge of surface 72' does not touch the stationary surface 76 during engine operation.

As previously explained, the inner element and the cover member 72 rotate together. Since the outer pump element 44 rotates a little slower than the inner element 42, there is a slight sliding movement between the outer element 44 and the surface 72' of cover member 72 during operation. The surface 72' of cover member 72 is biased toward the left in FIG. 2 against surfaces 42" and 44" by a wave washer type spring 78. Spring 78 is captured between the end surface 80 of journal portion 18 and cover member 72. An annular groove or channel 82 is formed in the cover member 72 to center the spring 78 about portion 12'.

During operation of the engine and its oil pump, oil pressure generated adjacent the outlet opening 34 is normally below a prescribed pressure level for which the engine and pump are designed. The wave washer type spring 78 is so designed and specified to maintain contact between the cover member and the elements 42, 44. However, when the oil pressure level at the outlet 34 is above the prescribed design level, the spring 78 is so designed and specified so that the pressure force moves the cover member 72 to the right as in FIG. 4. This allows sufficient oil to leak into the interior 24 to re-establish the prescribed pressure level in the pump accompanied by return of the cover member 72 against the elements 42, 44 by action of the spring 78.

Although only one embodiment of the combination oil pump and pressure regulator is illustrated in the drawings and described in detail, it should be clear that several modifications or design changes may be made without the resultant structure falling outside the scope of the invention as claimed hereafter.

I claim:

1. For an internal combustion engine, a combination oil pump and pressure regulator for a pressurized lubrication system, comprising: a pump housing formed in a recess in an interior wall of the engine, the recess having an end wall portion and a cylindrical outer wall portion; inner and outer pump elements arranged in coplanar relationship and housed substantially within the recess, the elements having first side surfaces in sliding engagement with the end wall of the recess; means including the crankshaft for rotating the pump elements; oil inlet means and oil outlet means through the recess's end wall for introducing and discharging oil to and from the pump elements to pumping spaces formed between the elements; a cover member having a flat surface normally abutting the second side surfaces of the pump elements; yieldable means to urge the cover's flat surface against the second side surfaces of the elements so that as the elements are rotated, oil is drawn from the inlet means, through the pump spaces and out the outlet means, whereby the yieldable means permits the cover to move away from the elements in response to a pressure force created by a predetermined high oil pressure at the pump outlet to thereby pass oil from the pump to reduce oil pressure.

2. The combination pump and pressure regulator set forth in claim 1 in which the elements have a common thickness dimension slightly greater than the depth of the recess determined by the width of the cylindrical wall portion whereby a plane defined by the second side surfaces of the elements is spaced outwardly from edge of the recess so that the cover member engages only the elements and not the interior wall of the engine.

3. The combination pump and pressure regulator set forth in claim 1 in which the crankshaft has a radially enlarged portion slightly spaced from the cover member; the cover member has a circular channel in a second side opposite the flat side; and a wave washer engages the channel and contacts the enlarged portion to yieldably bias the cover against the elements.

4. The combination pump and pressure regulator set forth in claim 1 in which the inner element and the cover are connected to the crankshaft so that they rotate together.

5. A combination gear type oil pump and pressure regulator for a lubrication system of an internal combustion engine including rotatable pump elements within a recess formed in an internal wall of the engine, the pump elements being connected to an end portion of an engine crankshaft which extends into the recess, the recess having an end wall extending normal to the axis of the crankshaft and having a cylindrical outer wall encircling the end portion of the crankshaft: the pump elements being arranged in a coplanar relationship and dimensioned to fit within the recess with first side faces thereof slidably engaging the end wall of the recess, oil inlet means and oil outlet means opening through the end wall of the recess for passing oil to and from a space between the pump elements; a cover member with a flat surface extending adjacent second opposite side faces of the pump elements; yieldable means urging the flat surface of the cover member into sliding and sealing contact with the second side faces of the pump elements, whereby a sufficient force on the cover member generated by a predetermined oil pressure at the pump outlet moves the cover member away from contact with the second side surfaces to permit oil to bypass the outlet means and thus reduce oil pressure.

6. The combination pump and pressure regulator set forth in claim 5 in which the elements have a common thickness dimension slightly greater than the depth of the recess determined by the width of the cylindrical wall portion whereby a plane defined by the second side surfaces of the elements is spaced outwardly from edge of the recess so that the cover member engages only the elements and not the interior wall of the engine.

7. The combination pump and pressure regulator set forth in claim 5 in which the crankshaft has a radially enlarged portion slightly spaced from the cover member; the cover member has a circular channel in a second side opposite the flat side; and a wave washer engages the channel and contacts the enlarged portion to yieldably bias the cover against the elements.

8. The combination pump and pressure regulator set forth in claim 5 in which the inner element and the cover are connected to the crankshaft so that they rotate together.

* * * * *